US008479820B2

(12) United States Patent
Kaul et al.

(10) Patent No.: US 8,479,820 B2
(45) Date of Patent: Jul. 9, 2013

(54) DISSIPATING HEAT FROM A DOWNHOLE HEAT GENERATING DEVICE

(75) Inventors: Anmol Kaul, Katy, TX (US); Lennox E. Reid, Jr., Houston, TX (US); Bill Grant, Cedar Creek, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 440 days.

(21) Appl. No.: 12/774,450

(22) Filed: May 5, 2010

(65) Prior Publication Data

US 2011/0272154 A1 Nov. 10, 2011

(51) Int. Cl.
*E21B 36/00* (2006.01)

(52) U.S. Cl.
USPC ..... 166/302; 166/57; 175/17; 165/96; 165/277

(58) Field of Classification Search
USPC ..... 166/272.1, 302, 57; 175/17; 165/96, 165/277, DIG. 132, DIG. 133, DIG. 135, 165/DIG. 137–DIG. 139, DIG. 153
See application file for complete search history.

(56) References Cited

U.S. PATENT DOCUMENTS

| | | | | | |
|---|---|---|---|---|---|
| 3,654,528 | A * | 4/1972 | Barkan | 257/714 |
| 4,206,341 | A * | 6/1980 | Leuschner et al. | 392/467 |
| 4,273,183 | A * | 6/1981 | Altoz et al. | 165/277 |
| 4,281,708 | A * | 8/1981 | Wing et al. | 165/277 |
| 4,679,636 | A * | 7/1987 | Ruhle | 175/58 |
| 5,875,096 | A * | 2/1999 | Gates | 361/704 |
| 6,608,752 | B2 * | 8/2003 | Morris et al. | 361/700 |
| 6,641,434 | B2 | 11/2003 | Boyle et al. | |
| 6,986,282 | B2 | 1/2006 | Ciglenec et al. | |
| 7,080,989 | B2 * | 7/2006 | Gates | 439/73 |
| 7,114,562 | B2 | 10/2006 | Fisseler et al. | |
| 7,806,173 | B2 * | 10/2010 | Kaul et al. | 166/57 |
| 2006/0005961 | A1 * | 1/2006 | Ashe et al. | 165/296 |
| 2011/0272135 | A1 * | 11/2011 | Kaul et al. | 166/57 |

OTHER PUBLICATIONS

IP.com publication, IPCOM000155987, Retractable Heat Dissipation, Mechanism for Down-hole Applications.

* cited by examiner

*Primary Examiner* — Jennifer H Gay
*Assistant Examiner* — Blake Michener
(74) *Attorney, Agent, or Firm* — Cathy Hewitt; John Vereb

(57) ABSTRACT

In one embodiment, a heat dissipating apparatus includes a chassis positionable within a housing of a downhole tool. The heat dissipating apparatus also includes a heat sink coupled to the chassis and a displacement mechanism coupled to the heat sink. The displacement mechanism is actuatable to move the heat sink, with respect to the chassis, between a first position and a second position such that in the first position the heat sink is radially retracted toward the chassis to form a gap between the heat sink and the housing and such that in the second position the heat sink is radially extended from the chassis to contact the housing.

17 Claims, 10 Drawing Sheets

DISSIPATING HEAT FROM A DOWNHOLE HEAT GENERATING DEVICE

BACKGROUND OF THE DISCLOSURE

Producing reservoir wells involves drilling surface formations and monitoring various subsurface formation parameters. Drilling and monitoring typically involves using downhole tools having high-powered electronic devices. During operation, the electronic devices generate heat that often builds up in a downhole tool. This built up heat may be detrimental to the operation of the downhole tool.

A traditional technique for dissipating the heat generated by these electronic devices involves using heat sinks in a downhole tool. A heat sink is an object that typically absorbs and dissipates heat from another object through thermal contact, conduction and/or transfer. Dissipating heat from an object with a high temperature may result in lowering the temperature of that object. For example, a heat sink is made from a material with high thermal conductivity and/or a large heat capacity, such as aluminum or copper. Efficient function of a heat sink may rely on rapid transfer of thermal energy from the first object to the heat sink.

Further, the use of a thermally conductive material, such as a thermal gel, paste, grease, or other thermally conductive substance, may increase the transfer of thermal energy. The thermally conductive material may be applied to a surface between the heat sink and other objects. The use of the thermally conductive material may help minimize thermal resistance between the objects.

Dissipating heat generated by heat generating devices through the use of thermally conductive materials, such as heat sinks or thermal substances, may help prevent detrimental heat build up and help maintain a heat generating device at an operable temperature in a downhole tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
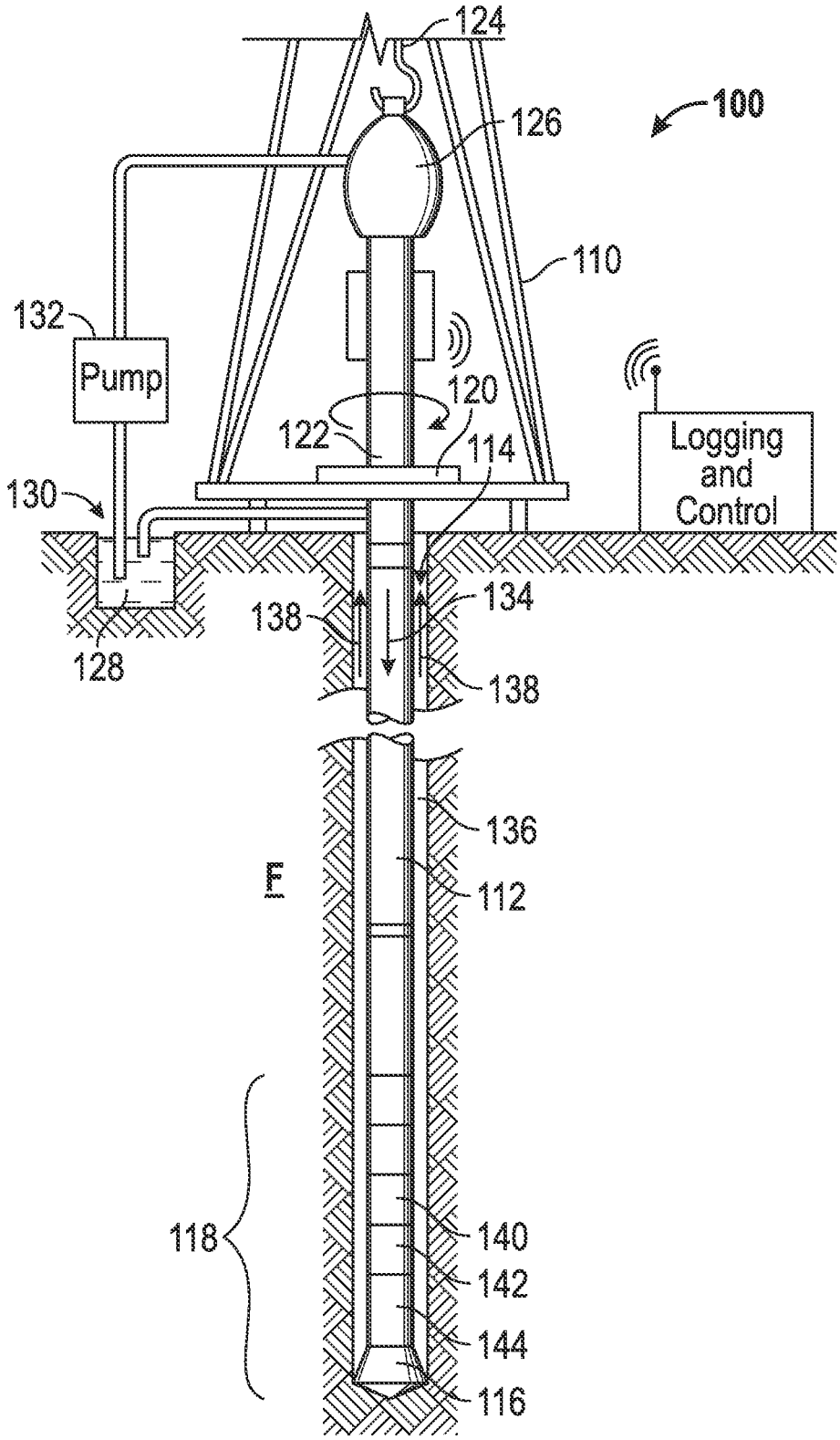
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, a schematic view of a wellsite 100 having a drilling rig 110 with a drill string 112 suspended therefrom in accordance with one or more aspects of the present disclosure is shown. The wellsite 100 shown, or one similar thereto, may be used within onshore and/or offshore locations. A borehole 114 may be formed within a subsurface formation F, such as by using rotary drilling, or other methods known in the art. As such, apparatus according to one or more aspects of the present disclosure may be used within a wellsite similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

The drill string 112 may suspend from the drilling rig 110 into the borehole 114. The drill string 112 may include a bottom hole assembly 118 and a drill bit 116, wherein the drill bit 116 may be disposed at an end of the drill string 112. The surface of the wellsite 100 may have the drilling rig 110 positioned over the borehole 114, and the drilling rig 110 may include a rotary table 120, a kelly 122, and a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

An upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used within the scope of the present disclosure. For example, a top-drive (also known as a "power swivel") system may be used. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, and a pump 132 may be used to pump the drilling fluid 128 into the wellbore 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. The drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118 disposed adjacent to the drill bit 116 within the drill string 112. The bottom hole assembly 118 may include one or more components included therein, such as components to measure, process, and store information. The bottom hole assembly 118 may include components to communicate and relay information to the surface of the wellsite.

For example, in the embodiment shown in FIG. 1, the bottom hole assembly 118 may include one or more logging-while-drilling ("LWD") tools 140 and/or one or more measuring-while-drilling ("MWD") tools 142. Further, the bottom hole assembly 118 may also include a steering-while-drilling system (e.g., a rotary-steerable system) and motor 144, wherein the rotary-steerable system and mud motor 144 may be coupled to the drill bit 116.

The LWD tool 140 may include a thick-walled housing, such as a drill collar, and may include one or more of a number of logging tools known in the art. Thus, the LWD tool 140 may be capable of measuring, processing, and/or storing information therein, and may comprise capabilities for communicating with equipment disposed at the surface of the wellsite 100.

The MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by drilling fluid flowing therethrough may be disposed within the MWD tool 142. Alternatively, other power generating sources and/or power storing sources (e.g., a battery) may be disposed within the MWD tool 142 to provide power within the bottom hole assembly 118. For example, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or other devices known in the art used within an MWD tool.

A heat generating device, such as a component of power electronics, may be implemented in the LWD tool 140 and the MWD tool 142, among elements of the bottom hole assembly 118. A heat sink may be disposed adjacent to the heat generating device and configured to dissipate heat from the heat generating device. To facilitate thermal contact between the heat sink and an inner wall of a drill collar while permitting removal of the heat sink from within the drill collar, a displacement mechanism may be disposed within the drill collar and may be configured to move the heat sink between a first position and a second position within the drill collar, wherein, in the first position, a gap is formed between the heat sink and the drill collar, and in the second position, the heat sink contacts the drill collar.

Figure 2:
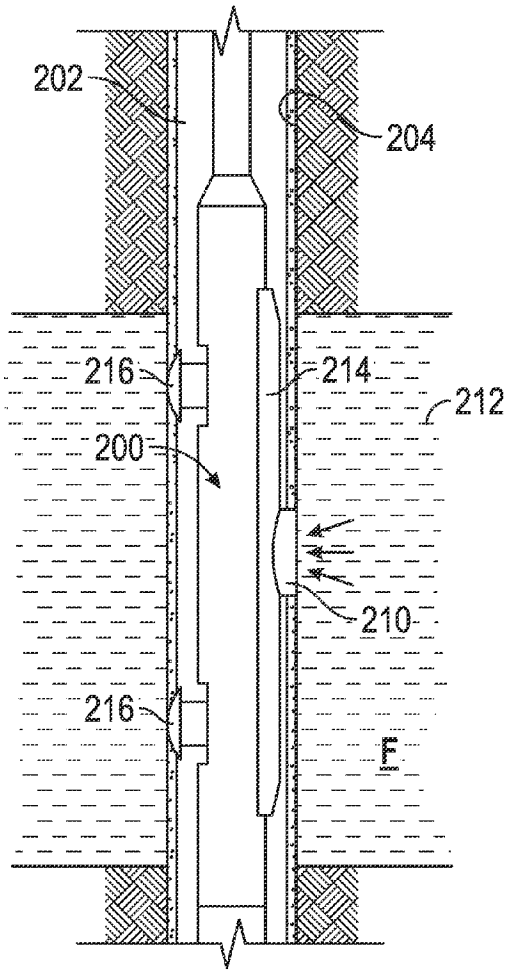
FIG. 2 is a schematic view of apparatus according to one or more aspects of the present disclosure.

Referring to FIG. 2, a schematic view of a tool 200 in accordance with one or more aspects of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

The tool 200 may include a sampling-while drilling ("SWD") tool, such as that described within U.S. Pat. No. 7,114,562, which is hereby incorporated herein by reference in its entirety. For example, the tool 200 may include a probe 210 to hydraulically establish communication with the formation F and draw formation fluid 212 into the tool 200.

The tool 200 may also include a stabilizer blade 214 and/or one or more pistons 216. As such, the probe 210 may be disposed on the stabilizer blade 214 and extend therefrom to engage the wall of the borehole 204. The pistons, if present, may also extend from the tool 200 to assist the probe 210 in engaging with the wall of the borehole 204. In alternative embodiments, though, the probe 210 may not necessarily engage the wall of the borehole 204 when drawing fluid.

Fluid 212 drawn into the tool 200 may be measured to determine one or more parameters of the formation F, such as pressure and/or pretest parameters of the formation F. Additionally, the tool 200 may include one or more devices, such as sample chambers or sample bottles, that may be used to collect formation fluid samples. These formation fluid samples may be retrieved back at the surface with the tool 200. Alternatively, rather than collecting formation fluid samples, the formation fluid 212 received within the tool 200 may be circulated back out into the formation F and/or borehole 204. As such, a pumping system may be included within the tool 200 to pump the formation fluid 212 circulating within the tool 200. For example, the pumping system may be used to pump formation fluid 212 from the probe 210 to the sample bottles and/or back into the formation F. Alternatively still, in one or more embodiments, rather than collecting formation fluid samples, a tool in accordance with embodiments disclosed herein may be used to collect samples from the formation F, such as one or more coring samples from the wall of the borehole 204.

The tool 200 may include a heat generating device, such as an alternator configured to provide electric power to the tool 200, an electric motor configured to actuate a fluid pumping system provided with the tool 200, and/or other heat generating devices. A heat sink may be disposed adjacent to the heat generating device and configured to dissipate heat from the heat generating device. To facilitate thermal contact between the heat sink and an inner wall of a drill collar of the tool 200 while permitting removal of the heat sink from within the drill collar, a displacement mechanism may be disposed within the drill collar and may be configured to move the heat sink between a first position and a second position within the drill collar, wherein, in the first position, a gap is formed between the heat sink and the drill collar, and in the second position, the heat sink contacts the drill collar.

Figure 3:
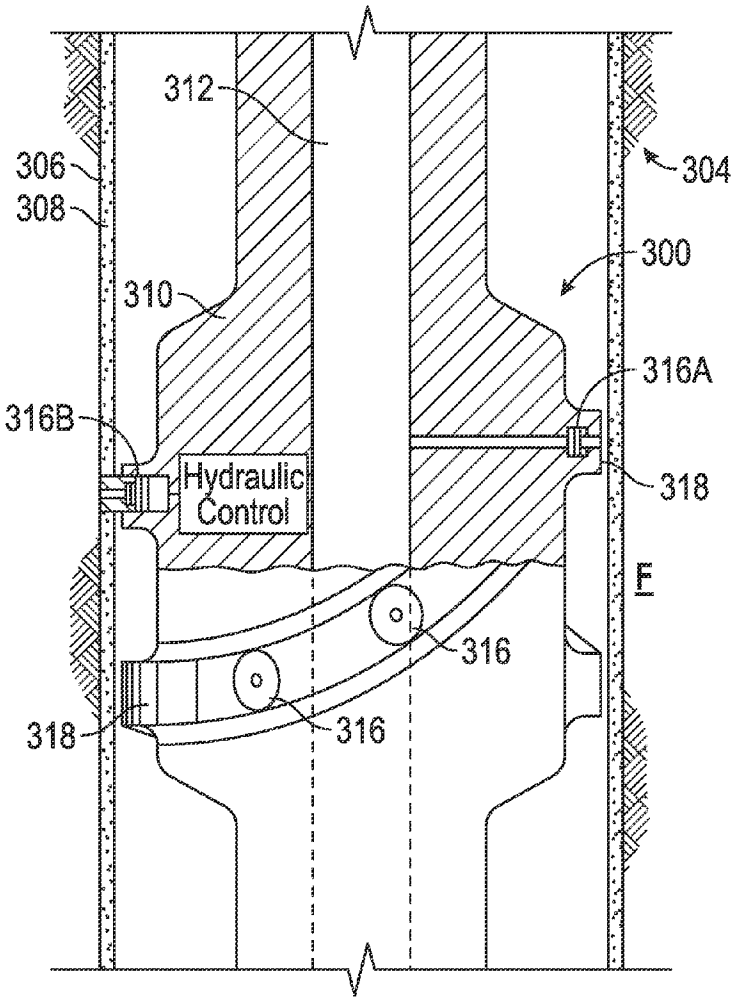
FIG. 3 is a schematic view of apparatus according to one or more aspects of the present disclosure.

Referring to FIG. 3, a schematic view of a tool 300 in accordance with one or more aspects of the present disclosure is shown. The tool 300 may be connected to and/or included within a bottom hole assembly (such as those described above), in which the tool 300 may be disposed within a borehole 304 formed within a subsurface formation F.

The tool 300 may be a pressure LWD tool used to measure one or more downhole pressures (such as annular pressure, formation pressure, and pore pressure) before, during, and/or after a drilling operation. Those having ordinary skill in the art will appreciate that other pressure LWD tools may also be utilized in one or more embodiments within the scope of the present disclosure, such as that described within U.S. Pat. No. 6,986,282, the entirety of which is hereby incorporated herein by reference.

The tool 300 may be formed as a modified stabilizer collar 310, similar to a stabilizer collar as described above, and may have a passage 312 formed therethrough for passing drilling fluid. The flow of the drilling fluid through the tool 300 may create an internal pressure $P_1$, and the exterior of the tool 300 may be exposed to an annular pressure $P_A$ of the surrounding borehole 304 and formation F. A differential pressure $P_\delta$ formed between the internal pressure $P_1$ and the annular pressure $P_A$ may then be used to activate one or more pressure devices 316 included within the tool 300.

The tool 300 may include two pressure measuring devices 316A and 316B that may be disposed on stabilizer blades 318 formed on the stabilizer collar 310. The pressure measuring device 316A may be used to measure the annular pressure $P_A$ in the borehole 304, and/or may be used to measure the pressure of the formation F when positioned in engagement with a wall 306 of the borehole 304. As shown in FIG. 3, the pressure measuring device 316A is not in engagement with the borehole wall 306, thereby enabling the pressure measuring device 316A to measure the annular pressure $P_A$, if desired. However, when the pressure measuring device 316A is moved into engagement with the borehole wall 306, the pressure measuring device 316A may be used to measure pore pressure of the formation F.

The pressure measuring device 316B may be extendable from the stabilizer blade 318, such as by using a hydraulic control disposed within the tool 300. When extended from the stabilizer blade 318, the pressure measuring device 316B may establish sealing engagement with the wall 306 of the borehole 304 and/or a mudcake 308 of the borehole 304. This may enable the pressure measuring device 316B to take measurements of the formation F also. Other controllers and circuitry (not shown) may be used to couple the pressure measuring devices 316 and/or other components of the tool 300 to a processor and/or a controller. Such processor and/or controller may then be used to communicate the measurements from the tool 300 to other tools within a bottom hole assembly or to the surface of a wellsite. As such, a pumping system may be included within the tool 300, such as including the pumping system within one or more of the pressure devices 316 for activation and/or movement of the pressure devices 316.

The tool 300 may include a heat generating device, such as an alternator configured to provide electric power to the tool 300, an electric motor configured to actuate a fluid pumping system provided with the tool 300, and/or other heat generating devices. A heat sink may be disposed adjacent to the heat generating device and configured to dissipate heat from the heat generating device. To facilitate thermal contact between the heat sink and an inner wall of a drill collar of the tool 300 while permitting removal of the heat sink from within the drill collar, a displacement mechanism may be disposed within the drill collar and may be configured to move the heat sink between a first position and a second position within the drill collar, wherein, in the first position, a gap is formed between the heat sink and the drill collar, and in the second position, the heat sink contacts the drill collar.

Figure 4:
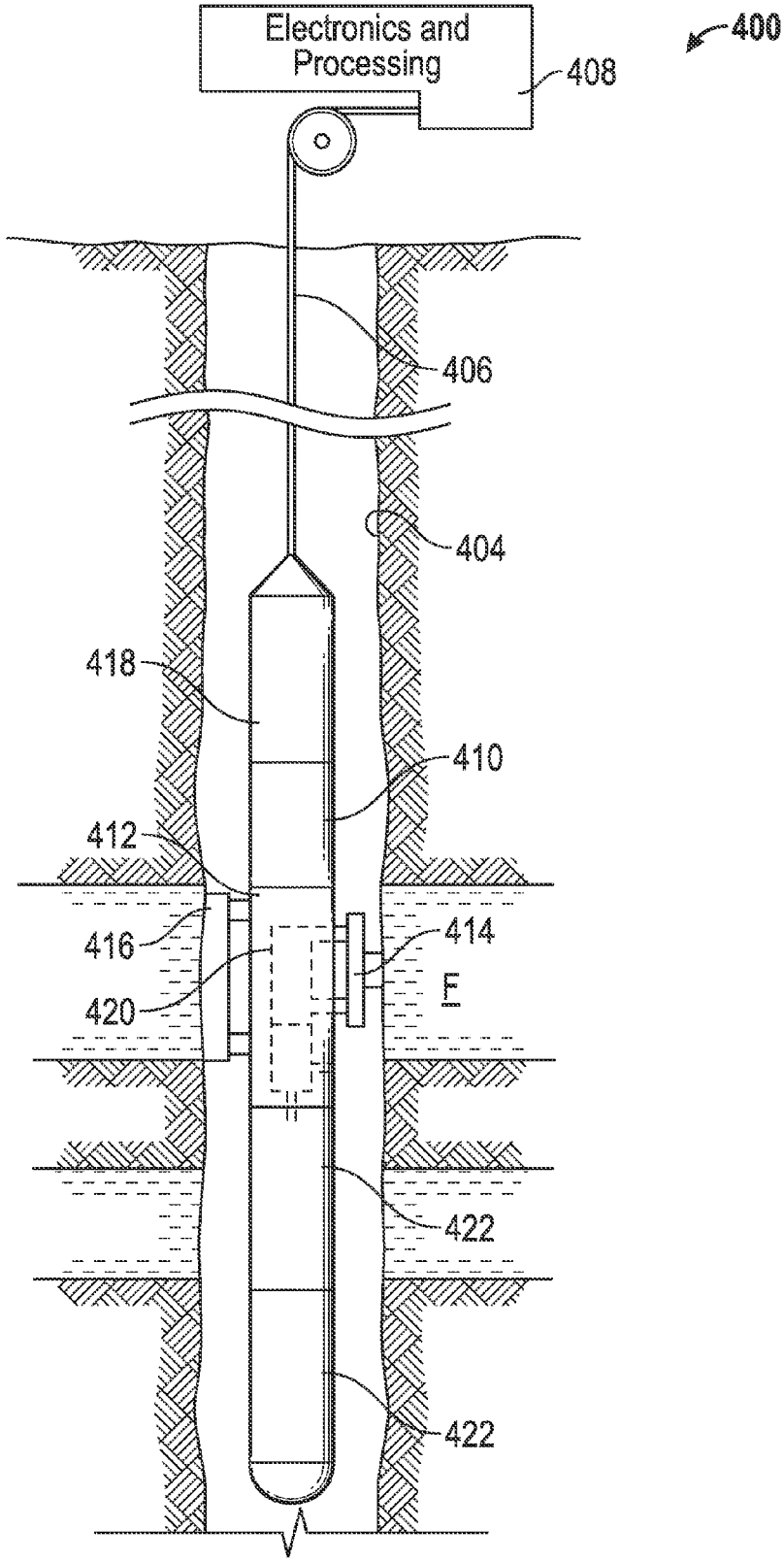
FIG. 4 is a schematic view of apparatus according to one or more aspects of the present disclosure.

Referring to FIG. 4, a schematic view of a tool 400 in accordance with one or more aspects of the present disclosure is shown. The tool 400 may be a "wireline" tool, in which the tool 400 may be suspended within a borehole 404 formed within a subsurface formation F. For example, the tool 400 may be suspended from an end of a multi-conductor cable 406 located at the surface of the formation F, such as by having the multi-conductor cable 406 spooled around a winch (not shown) disposed on the surface of the formation F. The multi-conductor cable 406 is then coupled the tool 400 with an electronics and processing system 408 disposed on the surface.

The tool 400 shown in this embodiment may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, including one or more measuring devices, may also be included within the tool 400.

The probe 414 may be included within the tool 400 such that the probe 414 may be able to extend from the body 410 and then selectively seal off and/or isolate selected portions of the wall of the borehole 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers or bottles 422, which may receive and retain fluids obtained from the formation F for subsequent testing after being received at the surface. The fluid from the probe 414 may also be sent back out into the borehole 404 or formation F.

The tool 400 may include a heat generating device, such as power electronics configured to transform the electric energy provided by the multi-conductor cable 406, an electric motor configured to actuate a fluid pumping system provided with the tool 400, and/or other heat generating devices. A heat sink may be disposed adjacent to the heat generating device and configured to dissipate heat from the heat generating device. To facilitate thermal contact between the heat sink and an inner wall of a housing of the tool 400 while permitting removal of the heat sink from within the housing, a displacement mechanism may be disposed within the housing and may be configured to move the heat sink between a first position and a second position within the housing, wherein, in the first position, a gap is formed between the heat sink and the housing, and in the second position, the heat sink contacts the drill collar.

Figure 5:
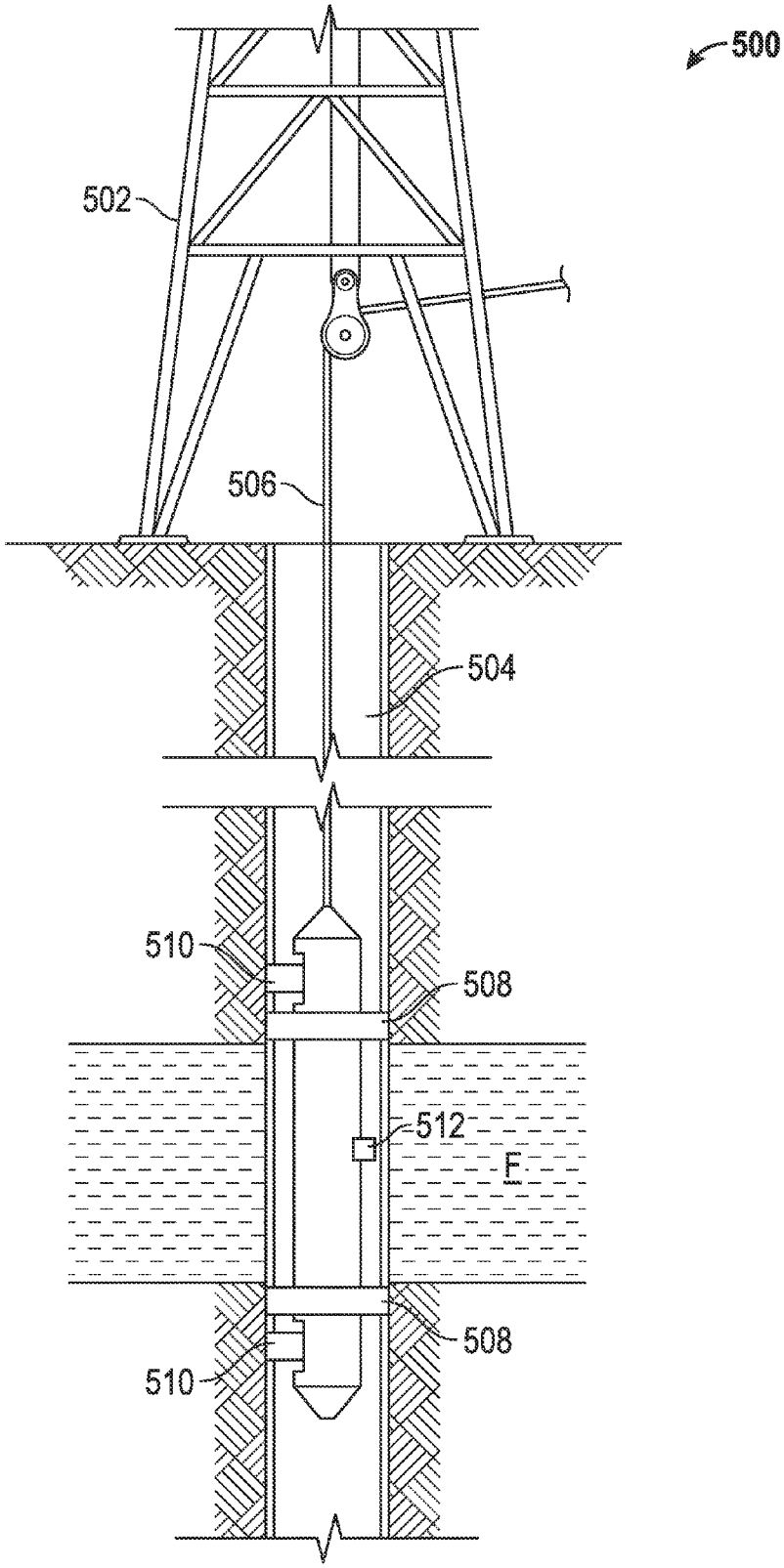
FIG. 5 is a schematic view of apparatus according to one or more aspects of the present disclosure.

Referring to FIG. 5, a schematic view of a tool 500 in accordance with one or more aspects of the present disclosure is shown. Similar to the above embodiment in FIG. 4, the tool 500 may be suspended within a borehole 504 formed within a subsurface formation F using a multi-conductor cable 506. In this embodiment, the multi-conductor cable 506 may be supported by a drilling rig 502.

The tool 500 may include one or more packers 508 that may be configured to inflate, thereby selectively sealing off a portion of the borehole 504 for the tool 500. To test the formation F, the tool 500 may include one or more probes 510, and the tool 500 may also include one or more outlets 512 that may be used to inject fluids within the sealed portion established by the packers 508 between the tool 500 and the formation F.

The tool 500 may include a heat generating device, such as power electronics configured to transform the electric energy provided by the multi-conductor cable 506, an electric motor configured to actuate a fluid pumping system provided with the tool 500, and/or other heat generating devices. A heat sink may be disposed adjacent to the heat generating device and configured to dissipate heat from the heat generating device. To facilitate thermal contact between the heat sink and an inner wall of a housing of the tool 500 while permitting removal of the heat sink from within the housing, a displacement mechanism may be disposed within the housing and may be configured to move the heat sink between a first position and a second position within the housing, wherein, in the first position, a gap is formed between the heat sink and the housing, and in the second position, the heat sink contacts the drill collar.

Figure 6:
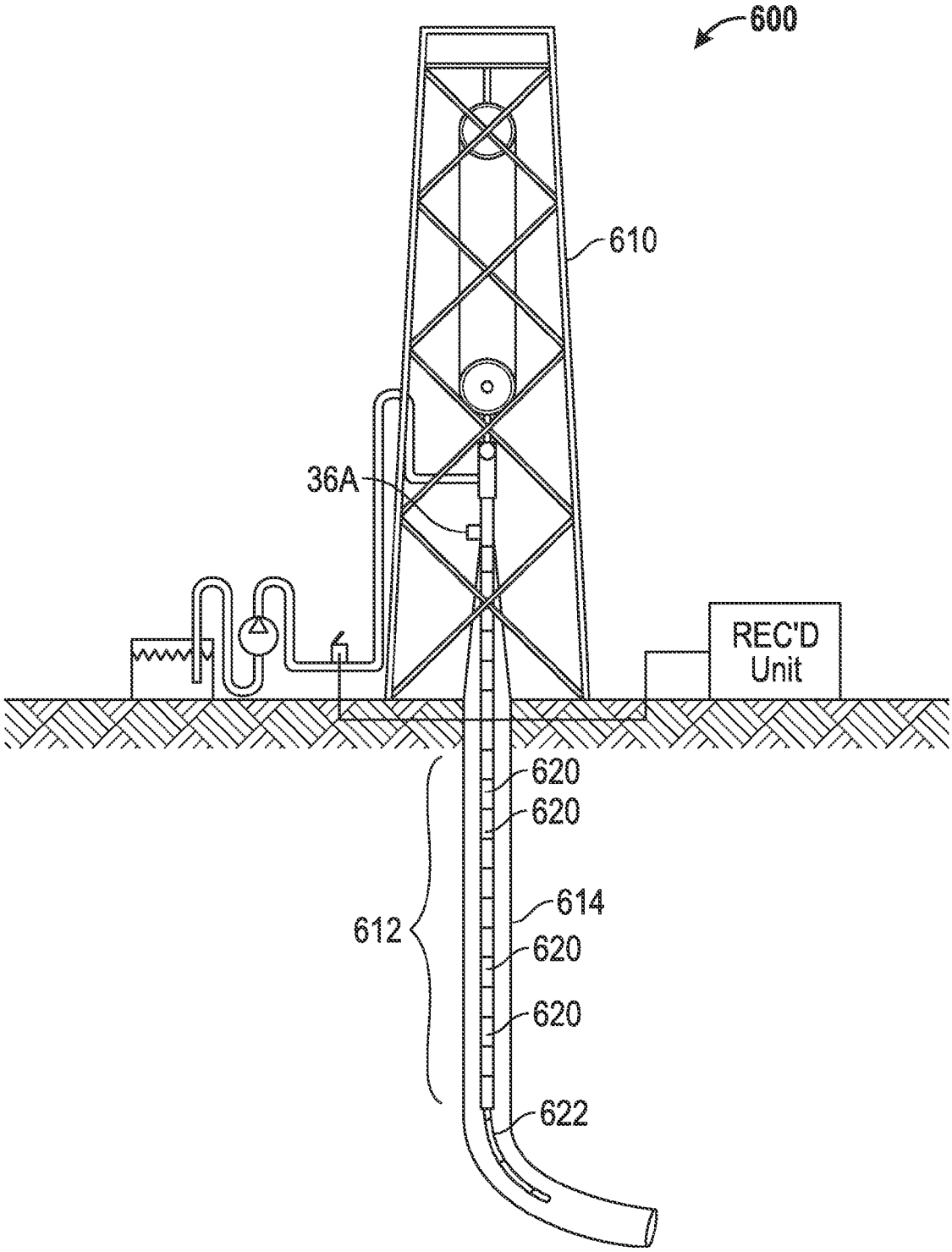
FIG. 6 is a schematic view of apparatus according to one or more aspects of the present disclosure.

Referring to FIG. 6, a schematic view of a wellsite 600 having a drilling rig 610 in accordance with one or more aspects of the present disclosure is shown. In this embodiment, a borehole 614 may be formed within a subsurface formation F, such as by using a drilling assembly, or any other method known in the art. A wired pipe string 612 is suspended from the drilling rig 610. The wired pipe string 612 may be extended into the borehole 614 by threadably coupling multiple segments 620 (i.e., joints) of wired drill pipe together in an end-to-end fashion. As such, the wired drill pipe segments 620 may be similar to that as described within U.S. Pat. No. 6,641,434, the entirety of which is hereby incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may be configured to be capable of a form of signal coupling, such as having inductive coupling, to communicate data and/or signals between adjacent pipe segments assembled together.

The wired pipe string 612 may include one or more tools 622 and/or instruments disposed within the pipe string 612. For example, as shown in FIG. 6, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612.

One or more of the tools 622 may include a heat generating device, such as an alternator configured to provide electric power to the tools 622, a pulsed neutron generator, and/or other heat generating devices. A heat sink may be disposed adjacent to the heat generating device and configured to dissipate heat from the heat generating device. To facilitate thermal contact between the heat sink and an inner wall of a housing of one of the tools 622 while permitting removal of the heat sink from within the housing, a displacement mechanism may be disposed within the housing and may be configured to move the heat sink between a first position and a second position within the housing, wherein, in the first position, a gap is formed between the heat sink and the housing, and in the second position, the heat sink contacts the drill collar.

A heat dissipating apparatus, and one or more methods of using a heat dissipating apparatus, in accordance with the present disclosure may be included within and/or implemented via one or more embodiments shown in FIGS. 1-6, in addition to being included with other tools and/or devices that may be disposed within a downhole formation. The heat dissipating apparatus, thus, may be used to help dissipate heat from a downhole heat generating device. The heat dissipating apparatus may be a used to dissipate heat within the tubular housing and/or outside the tubular housing. In the following figures, only a heat dissipating apparatus to dissipate heat from within a tubular housing is shown. However, those having ordinary skill will appreciate that other heat dissipating apparatuses may also be included within one or more embodiments within the scope of the present disclosure.

An apparatus to dissipate heat from a downhole heat generating device in accordance with one or more aspects of the present disclosure may include, at least, a heat sink to effectively dissipate heat from a heat generating device, such as, but not limited to, an electronic device used within a downhole tool, such as described above and/or shown in FIGS. 1-6. A heat sink typically functions by effectively transferring heat away from a body with a relatively high temperature. However, a heat sink may also function by transferring heat from a body with a relatively high temperature to another body with a lower temperature. For example, the heat sink may be made from a material with a high thermal conductivity, such as, but not limited to, aluminum or copper. When the heat sink is in thermal contact with the heat generating device, the heat sink may be able to absorb and/or dissipate heat away from the heat generating device, and thus may lower the temperature of the heat generating device.

Apparatus to dissipate heat from a heat generating device in accordance with one or more aspects of the present disclosure may also include, at least, a tubular housing with an axis defined therethrough. The tubular housing may also be in thermal contact with the heat sink and may receive heat generated by the heat generating device. For example, if the heat sink is in thermal contact with both the heat generating device and the tubular housing, heat generated by the heat generating device may be absorbed and/or dissipated by the heat sink, and transferred to another body at a lower temperature, such as the tubular housing, and/or to drilling fluid (mud) internal or external to the tool. The tubular housing may also serve as a heat sink and may dissipate the heat generated by the heat generating device. A thermally conductive material may be applied to one or more surfaces of the heat sink to reduce thermal resistance between the heat sink and the other contacting bodies, such as the tubular housing. The thermally conductive material may include a thermal gel, thermal paste, thermal grease, and/or other thermally conductive substances.

The heat sink of the apparatus to dissipate heat from a heat generating device in accordance with one or more aspects of the present disclosure may be mounted onto a chassis to be disposed within the tubular housing discussed above. The chassis may be configured to receive several different types of components and elements and is not limited to only receive components used to dissipate heat. For example, the chassis may be configured to receive a stabilizer that may be used to help stabilize the chassis within the tubular housing. In one or more aspects of the present disclosure, the chassis is configured to receive the heat sink, as previously discussed, with a displacement mechanism positioned between the chassis and the heat sink.

In accordance with one or more aspects of the present disclosure, a displacement mechanism may include a displacement member, a rolling assembly configured to engage the displacement member, and an actuator assembly coupled to the rolling assembly and configured to position the rolling assembly. Accordingly, a displacement mechanism may be a mechanism that moves an object in a given direction. For example, in accordance with one or more aspects of the present disclosure, the displacement mechanism may be disposed within a tubular housing and configured to move the heat sink between a first position and a second position within the tubular housing, such as, but not limited to, moving the heat sink toward and away from the chassis in the radial direction. Alternatively, the displacement mechanism may be a gear box assembly that may be configured to move the heat sink toward and away from the chassis in a radial direction. For example, a member may be actuated and positioned in an axial direction into a gear box assembly. The gear box assembly may then mechanically convert the displacement of the member in the axial direction into displacement of a second member in the radial direction. The second member may be configured to contact the heat sink and to move the heat sink in the radial direction.

In accordance with one or more aspects of the present disclosure, a displacement member may be a member that may be used to position a body. The displacement member may include a biasing member. For example, in accordance with one or more aspects of the present disclosure, the displacement member may be a bow spring. A bow spring may be non-rigid and curved in shape, in which the radial height of the center of the bow spring may be greater than the radial height of either end of the bow spring if the ends of the bow spring were fixed to an axial surface. The displacement member may be coupled to the heat sink and/or the chassis.

In accordance with one or more aspects of the present disclosure, the rolling assembly may have upper and lower rollers. An upper roller may allow bodies to roll along the upper surface of the rolling assembly, and a lower roller may allow bodies to roll along the lower surface of the rolling assembly. Having at least one upper roller and at least one lower roller included in a rolling assembly may allow simultaneous rolling of bodies contacting the upper surface and lower surface of the rolling assembly, respectively. For example, in one or more embodiments disclosed herein, the rolling assembly may move axially within a tubular housing between a first position and a second position while contacting the chassis and a displacement member. Alternatively, a rolling assembly may only include one of an upper roller or a lower roller, in which a body may only be able to roll along the surface of the rolling assembly which contains the roller. In other embodiments, the rolling assembly may have no rollers, but may instead form a spacer configured to slide against adjacent components, rather than roll against adjacent components.

In accordance with one or more aspects of the present disclosure, an actuator assembly may be coupled to the rolling assembly and configured to move the rolling assembly. For example, an actuator assembly may include a linear link coupled to the rolling assembly and a screw coupled to the linear link and configured to move the linear link. The screw may be configured to rotate between a first position and a second position and the linear link may be configured to move between a first and second position. For example, the linear link coupled to the rolling assembly may have an internal thread on one end to be coupled with the screw. Accordingly, actuation of the screw may force the linear link to move between a first position and a second position, which may further cause the rolling assembly to move between a first position and a second position. Alternatively, the actuator assembly may include a piston assembly that may be coupled to the rolling assembly, in which displacement of the piston assembly may cause the rolling assembly to similarly move.

Once the heat sink, the heat generating device disposed adjacent to the heat sink, and the displacement mechanism are mounted onto the chassis, the actuator assembly of the displacement mechanism may be actuated to move the heat sink to a first position, in which a gap is formed between the heat sink and the tubular housing when the heat sink is disposed within the tubular housing. The chassis and components mounted onto the chassis may then be disposed within the tubular housing. A thermally conductive material may be disposed onto the outer surface of the heat sink before the heat sink is disposed within the tubular housing. Once the chassis is in its final axial and radial orientation with respect to the tubular housing, the actuator assembly of the displacement mechanism may be actuated to move the heat sink from the first position to the second position, in which the heat sink contacts the tubular housing. The final axial and/or radial orientation of the chassis with respect to the tubular housing may be defined by a bumper that may be formed on either, or both, ends of the chassis. The bumper may contact a ridge, protrusion, or change in diameter within the tubular housing that may guide the chassis to a final axial and radial orientation within the tubular housing.

In accordance with one or more aspects of the present disclosure, the heat sink may move between a first position and a second position within the tubular housing, such as by actuating the actuator assembly of the displacement mechanism. The point of actuation of the actuator assembly, according to one or more aspects of the present disclosure, may be at least one screw. Accordingly, the rolling assembly, which may be in contact with the chassis and the displacement member, may control the displacement of the heat sink between the first position and second position within the tubular housing. For example, the screw of the actuator assembly may rotate to a first position that may cause the linear link to move to a first position that may, further, cause the rolling assembly to move to a first position. The displacement of the rolling assembly in contact with the displacement member to a first position may cause the heat sink to move to the first position, such that a gap is formed between the heat sink and the tubular housing. The first positions of the screw, the linear link, and the rolling assembly may be defined as any position in which a gap is formed between the heat sink and the tubular housing.

Alternatively, the screw of the actuator assembly may rotate to a second position that may cause the linear link to be positioned to a second position, which may, further, cause the rolling assembly to move to a second position. The displacement of the rolling assembly in contact with the displacement member to a second position may cause the heat sink to move to the second position, in which the heat sink contacts the tubular housing. The second positions of the screw, the linear link, and the rolling assembly may be defined as any position in which the heat sink contacts the tubular housing. Further, the actuator assembly may be actuated externally, e.g., from outside of the tubular housing, by hand or by using a tool or assembly (not shown).

Figure 7A:
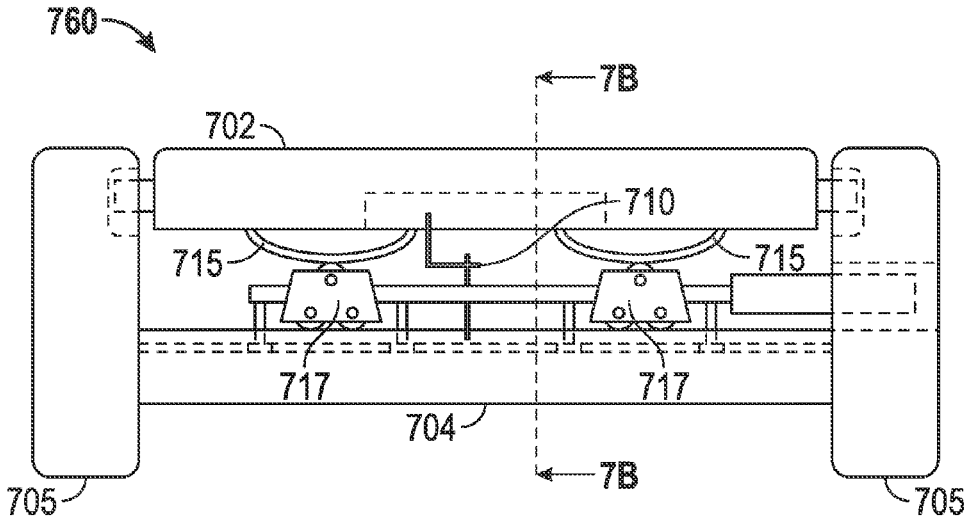
FIGS. 7A and 7B are alternate schematic views of apparatus according to one or more aspects of the present disclosure.
Figure 7B:
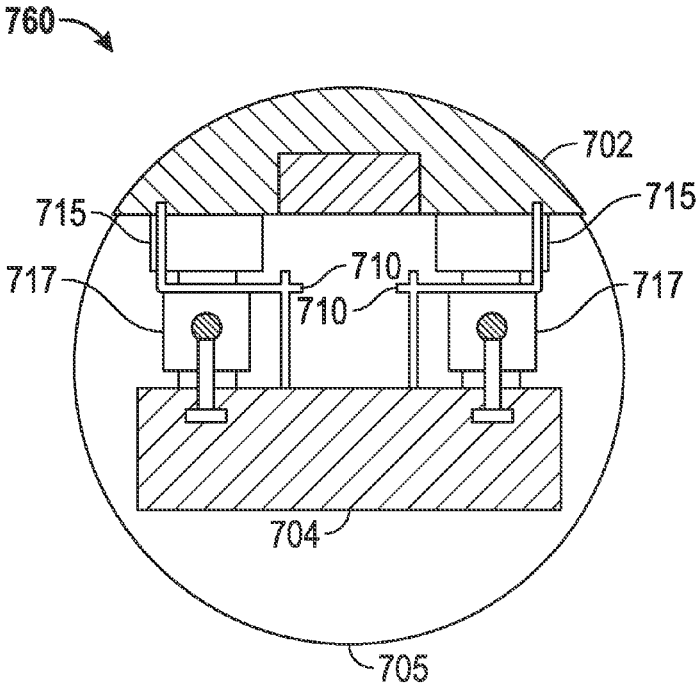

Referring to FIGS. 7A and 7B, multiple views of a heat dissipation apparatus 760 in accordance with one or more aspects disclosed herein are shown. A heat dissipation apparatus 760 in accordance with one or more aspects disclosed herein may include, at least, a tubular housing (not shown), a heat generating device (not shown) disposed within the tubular housing, a heat sink 702 disposed adjacent to the heat generating device, a displacement mechanism disposed within the tubular housing to move the heat sink 702 between a first position and a second position within the tubular housing, and a chassis 704 disposed within the tubular housing. A displacement mechanism in accordance with one or more aspects disclosed herein may include, at least, a displacement member 715 mounted to the heat sink 702, a rolling assembly 717 configured to engage displacement member 715 and move axially within the tubular housing, and an actuator assembly (not shown) coupled to and configured to move the rolling assembly 717.

The displacement members 715 may be mounted to an inner surface of the heat sink 702. A rolling assembly 717 may contact both the chassis 704 and the displacement members 715. The displacement members 715 may be bow springs, as shown in FIGS. 7A and 7B; however, those having ordinary skill will appreciate that alternatives may be used to urge the heat sink 702 away from the chassis 704. For example, instead of a bow spring, the displacement members 715 may comprise other rigid or non-rigid members that may be used in combination with the 717 rolling assembly to urge the heat sink 702 away from the chassis 704.

As shown in FIG. 7A, bumpers 705 may be formed at a top end and/or bottom end of chassis 704. The bumpers 705 may be configured to help guide the chassis 704 radially and axially when disposed within a tubular housing. The bumpers 705 may be made from a rigid material, such as a metal, or from a non-rigid material, such as rubber. However, those having ordinary skill will appreciate that alternative embodiments and configurations may be used to help guide chassis 704 within a tubular housing. For example, bumpers may not be used at all to help guide chassis 704 within a tubular housing. The chassis 704 may be configured with ridges or protrusions to help guide itself within a tubular housing to a final axial and radial orientation without the use of bumpers 705. Alternatively, the tubular housing may be configured with ridges or protrusions to help guide chassis 704 within the tubular housing to a final axial and radial orientation without the use of bumpers 705.

As shown in FIG. 7B, the heat sink 702 may be biased towards the chassis 704 with a biasing mechanism 710, such as torsion springs. The biasing mechanism 710 may bias the heat sink 702 toward the chassis 704 such as to help secure the heat sink 702 to the chassis 704 before the chassis 704 is disposed within a tubular housing (not shown). In order for the heat sink 702 to move between a first position and a second position, such as to move the heat sink 702 radially outward, the force caused by a displacement mechanism may need to exceed the biasing force caused by the biasing mechanism 710. The biasing mechanism 710 may be or comprise a torsion spring; however, those having ordinary skill will appreciate that alternatives may be used to bias the heat sink 702 towards the chassis 704 without departing from the scope of the present disclosure. For example, instead of a torsion spring, any other type of spring or biasing member may be used to bias the heat sink 702 towards the chassis 704.

Figure 8:
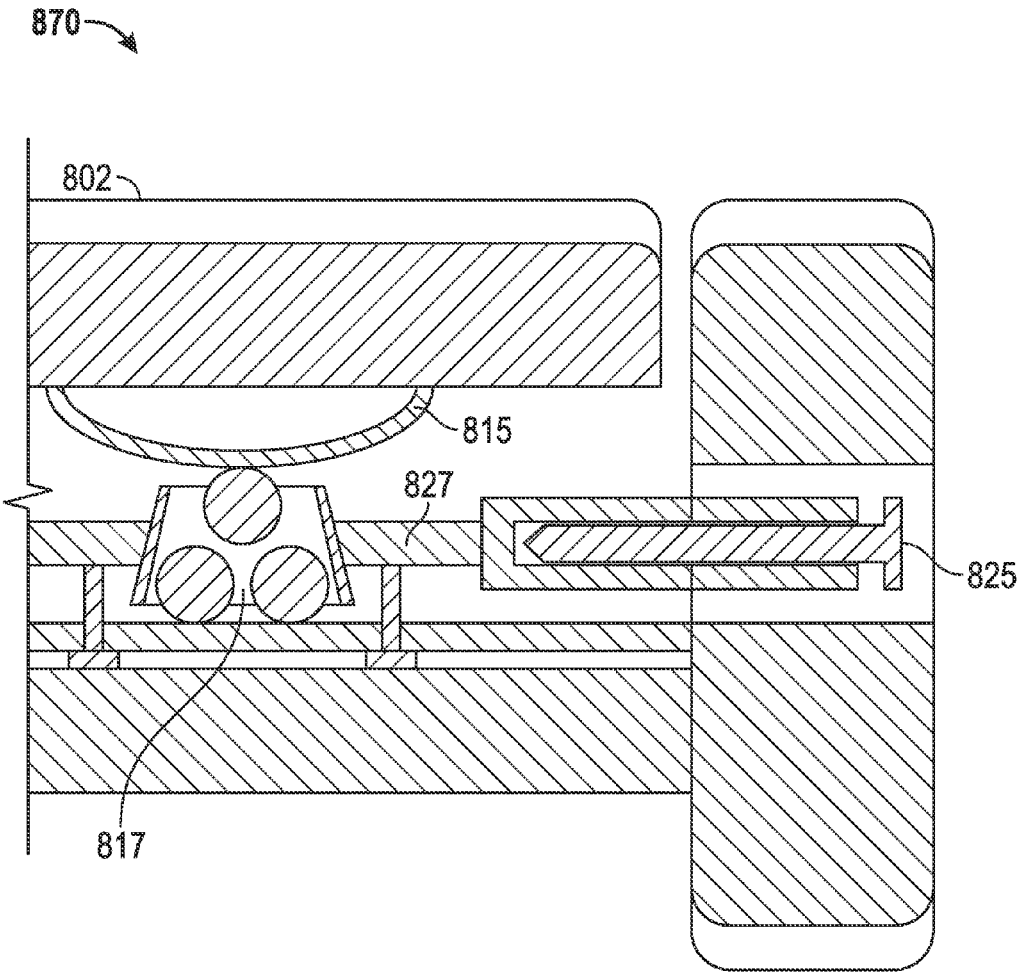
FIG. 8 is a schematic view of apparatus according to one or more aspects of the present disclosure.

Referring to FIG. 8, a detailed view of a displacement mechanism 870 of a heat dissipation apparatus 760 in accordance with one or more aspects disclosed herein is shown. The displacement mechanism 870 of a heat dissipation apparatus 760 may include a displacement member 815 coupled to a heat sink 802, a rolling assembly 817 configured to engage displacement member 815 and move axially within a tubular housing, and an actuator assembly coupled to the rolling assembly 817 and configured to move the rolling assembly 817.

As shown in FIG. 8, the rolling assembly 817 may contact a chassis 804 and the displacement members 815, wherein the displacement member 815 may be coupled to a heat sink 812. An actuator assembly in accordance with one or more aspects disclosed herein may include a linear link 827 coupled to and configured to move the rolling assembly 817, and at least one screw 825 coupled to and configured to move the linear link 827.

The displacement mechanism 870 may move the heat sink 802 from a first position to a second position through actuation of the actuator assembly. The screw 825, coupled to the linear link 827, may rotate from a first position to a second position, which may cause the linear link 827 to move from a first position to a second position. Moving the linear link 827 from the first position to the second position may cause the rolling assembly 817 to move axially along the chassis 804 and the displacement member 815 from a first position to a second position. Moving the rolling assembly 817 from the first position to the second position may cause the heat sink 802, to which the displacement member 815 is mounted, to move radially outward (i.e., away from chassis 804) from a first position to a second position.

The linear link 827 may have an internal thread formed into one end and may be further connected to the screw 825; however, those having ordinary skill will appreciate that alternative means of connection may be used to connect the linear link 827 to the screw 825. For example, instead of an internal thread connected to the screw 825, a piston assembly may be used to couple with the rolling assembly 817 to move the rolling assembly 817 between a first position and a second position. Further, those having ordinary skill will appreciate that the linear link 827 may not be required for the displacement mechanism 870 to function in accordance with one or more aspects disclosed herein. For example, the screw 825 may extend to directly contact the rolling assembly 817 without the use of an intermediate contacting body, such as the linear link 827.

Figure 9A:
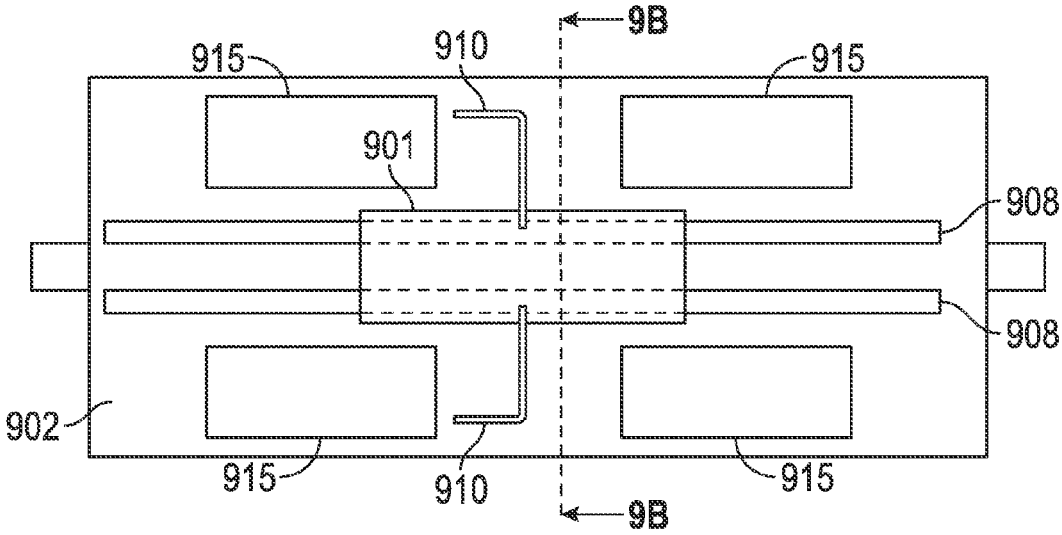
FIGS. 9A and 9B are alternate schematic views of apparatus according to one or more aspects of the present disclosure.
Figure 9B:
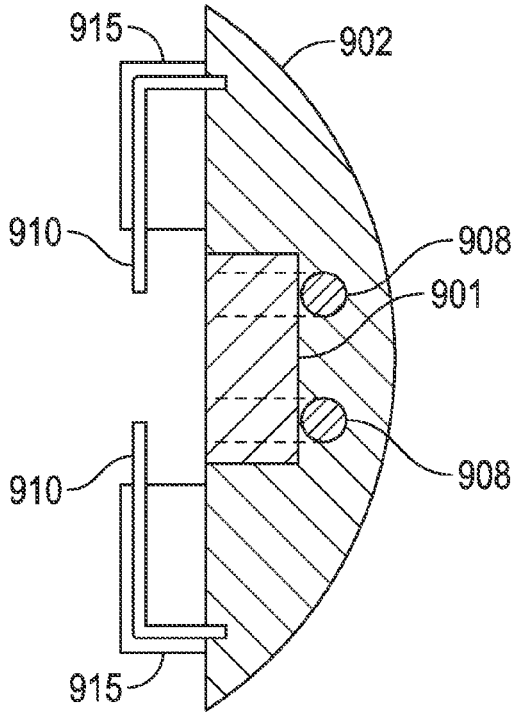

Referring to FIGS. 9A and 9B, multiple views of a heat sink 902 and a heat generating device 901 in accordance with one or more embodiments disclosed herein are shown. As shown, the heat sink 902 may be semi-cylindrical in shape, in which a portion of the inner surface may be flat and the outer surface may be curved. However, those having ordinary skill will appreciate that alternative shapes may be used to dispose the heat sink 902 coupled to a chassis in a tubular housing. For example, instead of the heat sink 902 being semi-cylindrical in shape to be received within a tubular housing, the heat sink 902 may be rectangular or pyramidal as long as the chassis may be configured to receive the heat sink 902 and the chassis and heat sink 902 may be disposed within the tubular housing.

The biasing mechanisms 910, such as torsion springs, may be mounted to the heat sink 902 to bias the heat sink 902 and the components mounted onto the heat sink 902 toward a chassis (not shown). In order for the heat sink 902 to move away from the chassis, the displacement force to move the heat sink 902 away from the chassis may need to overcome the biasing force of the biasing mechanisms 910.

With reference to FIG. 9B, both the heat generating device 901 and the displacement members 915 are shown disposed adjacent to the inner surface of the heat sink 902. For example, the heat generating device 901 may be in thermal contact with the heat sink 902. This may allow heat sink 902 to absorb and dissipate at least some of the heat generated by the heat generating device 901.

The heat sink 902 may have channels (not shown) formed into the heat sink 902 under the heat generating device 901 to allow cylindrical heat pipes 908 to be placed within the channels of the heat sink 902. The heat pipes 908 may also be made from a material with a high thermal conductivity, such as, but not limited to, copper or aluminum. The heat pipes 908 may include a volume of fluid, such as, but not limited to, water, ethanol, acetone, or mercury, and may help the heat sink 902 effectively conduct heat by means of matter phase transition. However, those with ordinary skill in the art will appreciate that the heat pipes 908 may be omitted. For example, placing the heat generating device 901 in thermal contact with the heat sink 902 without the further placement of heat pipes 908 may still dissipate sufficient heat from the heat generating device 901.

Figure 10A:
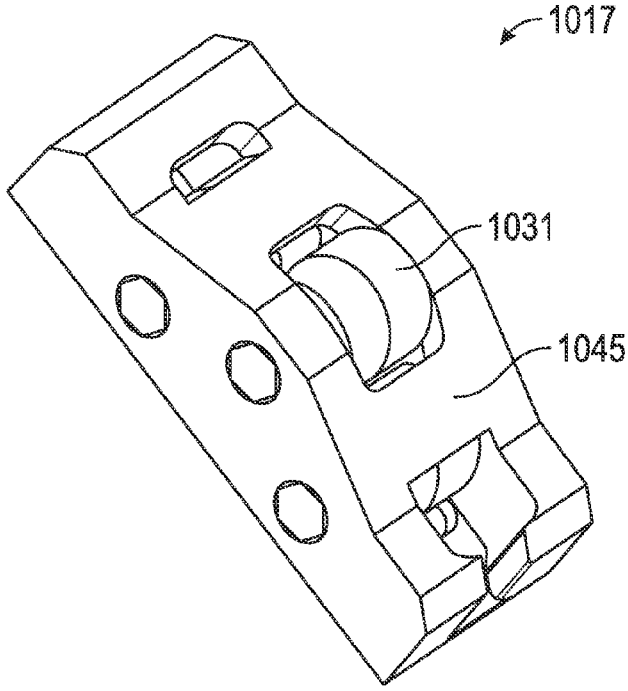
FIGS. 10A and 10B are alternate schematic views of apparatus according to one or more aspects of the present disclosure.
Figure 10B:
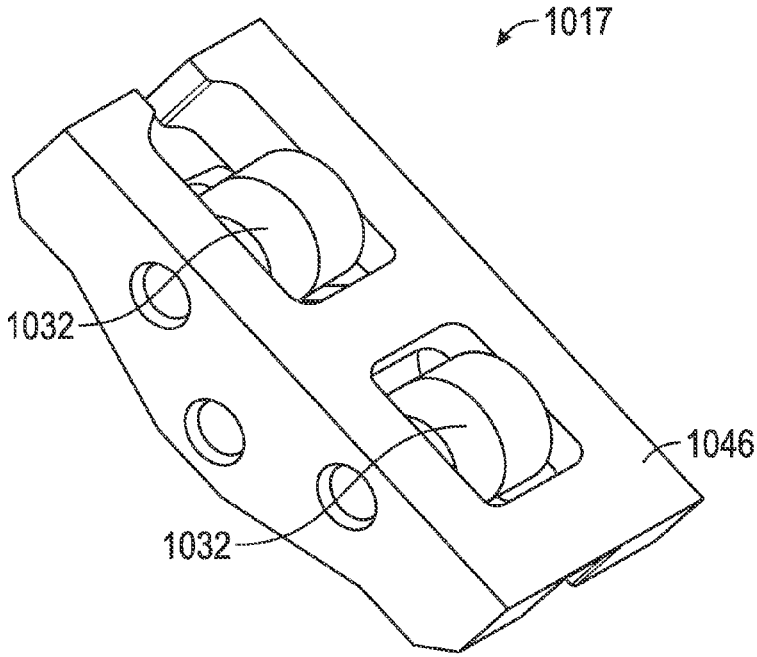

Referring to FIG. 10, a perspective view of an exemplary roller assembly 1017 in accordance with one or more aspects disclosed herein is shown. The roller assembly 1017 may have an upper surface 1045 and a lower surface 1046 and may include at least one upper roller 1031 and at least one lower roller 1032. The upper roller 1031 may allow bodies to roll along or adjacent to the upper surface 1045 of the rolling assembly 1017, and the lower roller 1032 may allow bodies to roll along or adjacent to the lower surface 1046 of the rolling assembly 1017. However, those having ordinary skill in the art will appreciate that alternative means may be used to allow bodies in contact to roll along surfaces of the rolling assembly 1017. For example, instead of roller assembly 1017 having at least one upper roller 1031 and at least one lower roller 1032, a body without rollers 1031 and 1032 may be used, such as a body having a low coefficient of friction along upper surface 1045 and lower surface 1046. (Accordingly, at least in the context of the present disclosure, the rolling assembly 1017 with the rollers 1031 and 1032 and a body without rollers may be collectively referred to herein as a spacer.)

Figure 11A:
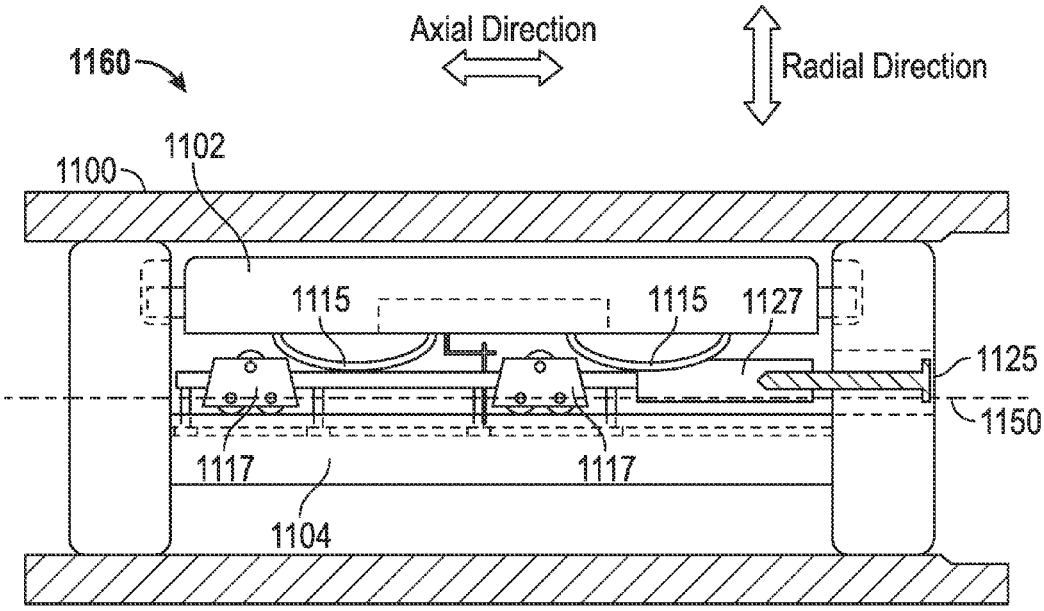
FIGS. 11A and 11B are schematic views of apparatus according to one or more aspects of the present disclosure.
Figure 11B:
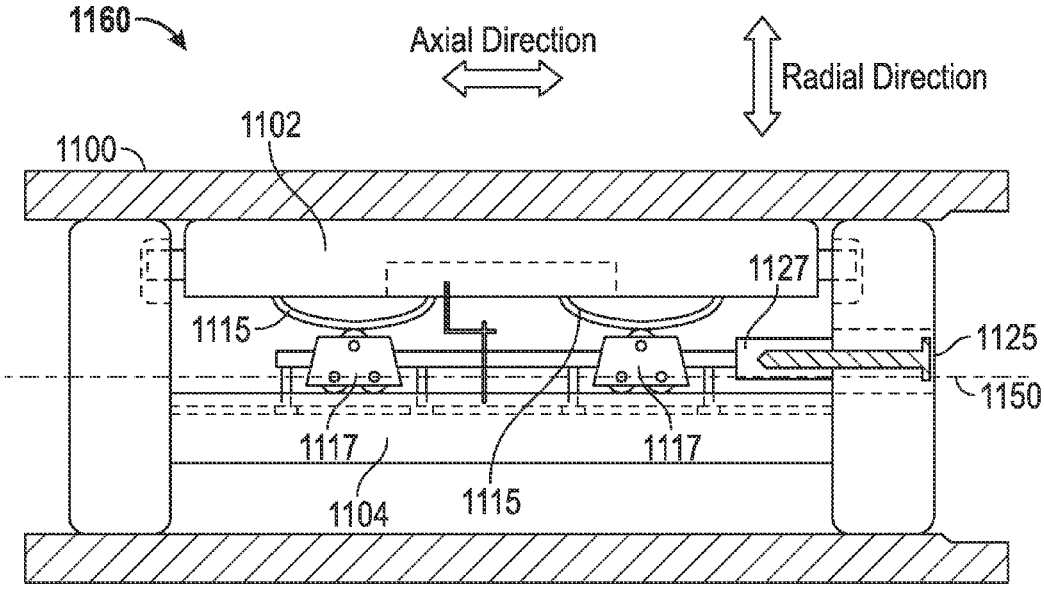

Referring to FIGS. 11A and 11B, cross-sectional views of a heat dissipation apparatus 1160 according to one or more aspects of the present disclosure are shown. The heat dissipation apparatus 1160 may include, at least, a tubular housing 1100, a heat generating device disposed within the tubular housing 1100, a heat sink 1102 disposed adjacent to the heat generating device, a displacement mechanism disposed within the tubular housing 1100 to move the heat sink 1102 between a first position and a second position within the tubular housing 1100, and a chassis 1104 disposed within the tubular housing 1100. A displacement mechanism in accordance with one or more aspects disclosed herein may include, at least, a displacement member 1115 mounted to the heat sink 1102, a rolling assembly 1117 configured to engage the displacement member 1115 and move axially within the tubular housing 1100, and an actuator assembly coupled to and configured to move the rolling assembly 1117. An actuator assembly in accordance with one or more aspects disclosed herein may include a linear link 1127 coupled to and configured to move the rolling assembly 1117, and at least one screw 1125 coupled to and configured to move the linear link 1127.

As shown in FIGS. 11A and 11B, the heat sink 1102 may be mounted onto the chassis 1104 and disposed within the tubular housing 1100 with an axis 1150 defined therethrough. The displacement members 1115 may be mounted onto the heat sink 1102 and the rolling assemblies 1117 may move between the displacement members 1115 and the chassis 1104. A linear link 1127 may be coupled to the rolling assemblies 1117. The linear link 1127 may be coupled to the screw(s) 1125 which may be rotated between a first position and a second position. The screw(s) 1125 may be actuated externally, e.g., outside of tubular housing 110, by hand, or by using a tool or assembly (not shown).

As the rolling assembly 1117 is moved from one end of displacement member 1115 toward the center of displacement member 1115, the curved shape of displacement member 1115 may force the heat sink 1102, on which the displacement member 1115 may be mounted, to move away from the rolling assembly 1117 and away from the chassis 1104, which the rolling assembly 1117 may contact. As shown, moving the heat sink 1102 away from the rolling assembly 1117 and the chassis 1104 may result in the heat sink 1102 moving in the radial direction toward the tubular housing 1100.

Conversely, as rolling assembly 1117 is moved away from the center of the displacement member 1115 toward an end of the displacement member 1115, the curved shape of the displacement member 1115 may allow the heat sink 1102, on which the displacement member 1115 may be mounted, to move toward the rolling assembly 1117 and toward the chassis 1104, which the rolling assembly 1117 may contact, in a radial direction away from the tubular housing 1100.

As shown in FIG. 11A, the screw 1125 may be rotated to a first position (or in a first direction). Rotating the screw 1125 to the first position (or in the first direction) may cause the linear link 1127 to move to a first position. Moving the linear link 1127 to the first position may cause the rolling assembly 1117 to move to a first position. Further, moving the rolling assembly 1117, which may be in contact with the bow spring 1115, to the first position may cause the heat sink 1102 to move to a first position, in which a gap is formed between the heat sink 1102 and the tubular housing 1100. The first positions of the screw 1125, the linear link 1127, and the rolling assembly 1117 may be defined as any position in which a gap is formed between the heat sink 1102 and the tubular housing 1100.

Similarly, as shown in FIG. 11B, the screw 1125 may be rotated to a second position (or in a second direction). Rotating the screw 1125 to the second position (or in the second direction) may cause the linear link 1127 to move to a second position. Moving the linear link 1127 to the second position may cause the rolling assembly 1117 to move to a second position. Moving the rolling assembly 1117, which may be in contact with the bow spring 1115, to the second position may cause the heat sink 1102 to move to a second position, in which the heat sink 1102 contacts the tubular housing 1100. The second positions of the screw 1125, the linear link 1127, and the rolling assembly 1117 may be defined as any position in which the heat sink 1102 contacts the tubular housing 1100.

An alternative embodiment may allow a heat sink mounted onto a chassis disposed within a tubular housing to move from a first position and a second position within the tubular housing, similar to that described above, using a rolling assembly with only one roller disposed on either the upper or lower surface of the rolling assembly. The heat generating device and a displacement member (i.e., a bow spring) may be mounted onto the heat sink, similar to those embodiments described above. However, only one end of the displacement member may be fixed to the heat sink. The other end of the displacement member may be coupled to the rolling assembly. The rolling assembly may be further coupled to a linear link, which may be internally threaded to receive a screw. The rolling surface of the rolling assembly may contact the chassis and may move axially along the chassis. As the screw may be rotated to a first position, the linear link may also move to a first position. The movement of the linear link to the first position may force the rolling assembly and the end of the displacement member coupled to the rolling assembly to also move to a first position. The first positions of the screw, the linear link, the rolling assembly, and the displacement member may be defined as any position in which a gap is formed between the heat sink and the tubular housing. As the screw may be rotated to a second position, the linear link, the rolling assembly coupled to the linear link, and the end of the displacement member coupled to the rolling assembly may move to a second position. As the displacement member is positioned to the second position, the axial distance between the fixed end of the displacement member and the other end of the displacement member coupled to the rolling assembly which may be positioned axially along the chassis may become shorter in length when compared to the axial distance between the two ends of the displacement member in the first position. A reduced axial length between the two ends of the displacement member in the second position may cause the radial height of the center of the displacement member to become larger when compared to the radial height of the center of the displacement member in the first position. An increased radial height of the center of the displacement member may cause the heat sink, on which the displacement member is mounted, to move to a second position, in which the heat sink contacts the tubular housing. The second positions of the screw, the linear link, the rolling assembly, and the displacement member may be defined as any position in which the heat sink contacts the tubular housing.

Embodiments disclosed herein may provide for one or more of the following advantages. An apparatus and a method in accordance with one or more aspects of the present disclosure may be included within one or more of the embodiments shown in FIGS. 1-6, in addition to being included within other tools and/or devices that may be disposed downhole within a formation. Further, an apparatus and a method in accordance with one or more aspects of the present disclosure may be able to dissipate heat from a heat generating device. Heat generated by a heat generating device may be dissipated through a heat sink and other bodies in thermal contact with the heat generating device or heat sink such as, but not limited to, heat pipes, a chassis, or a tubular housing. A thermally conductive material that may be disposed onto contacting surfaces of the apparatus may reduce thermal resistance between the components of the apparatus onto which the thermally conductive material is disposed. Reducing thermal resistance between bodies may improve the ability of the surface or material to dissipate heat. Dissipating heat from a heat generating device may lower the temperature of the heat generating device and may prevent the device from overheating and/or improve the operating conditions of the heat generating device.

Further, moving a heat sink mounted onto a chassis to be disposed within a tubular housing to a first position in which the a gap is formed between the heat sink and a tubular housing may prevent the heat sink from contacting and dragging along the inner surface of the tubular housing upon disposal into to the tubular housing. This may prevent any thermally conductive material that may be disposed onto the outer surface of the heat sink from being scraped off or displaced when the heat sink and the chassis are axially disposed within the tubular housing. Once the chassis is in its final axial position within the tubular housing, the heat sink may then be displaced to a second position within the tubular housing, in which the heat sink contacts the tubular housing. Moving the heat sink from the first position to the second position within the tubular housing may prevent any thermally conductive material disposed onto a surface between the heat sink and the tubular housing from being displaced due to contact between the heat sink and the tubular housing upon disposing the heat sink and the chassis within the tubular housing. Contact between the heat sink and the tubular housing while the heat sink and the chassis are axially disposed within the tubular housing may result in the thermally conductive material being scraped off or displaced from the surface onto which it may be disposed. The displacement of the heat sink between the first position and the second position may occur once the heat sink and chassis reach a final axial orientation within the tubular member and may be actuated externally by rotating the screw between a first and second position by hand or using a tool or assembly. Further, the displacement of the heat sink between the first position and the second position may be in the radial direction. As such, the displacement or scraping of the thermally conductive material may be minimized as the heat sink contacts the tubular housing.

The present disclosure introduces a heat dissipating apparatus to be used within a downhole tool. The apparatus includes a tubular housing having an axis defined therethrough, a heat generating device disposed within the tubular housing, a heat sink disposed adjacent to the heat generating device and configured to dissipate heat from the heat generating device, and a displacement mechanism disposed within the tubular housing and configured to move the heat sink between a first position and a second position within the tubular housing in which, in the first position, a gap is formed between the heat sink and the tubular housing, and in the second position, the heat sink contacts the tubular housing.

The present disclosure also introduces a method to dissipate heat from a downhole heat generating device to be used within a downhole tool. The method includes providing a tubular housing having an axis defined therethrough, disposing a heat generating device within the tubular housing, disposing a heat sink within the tubular housing, in which the heat sink is disposed adjacent to the heat generating device and is configured to dissipate heat from the heat generating device, disposing a displacement mechanism within the tubular housing, and moving the heat sink from a first position to a second position within the tubular housing with the displacement mechanism, in which, in the first position, a gap is formed between the heat sink and the tubular member, and in the second position, the heat sink contacts the tubular housing.

The present disclosure also introduces an apparatus comprising: a downhole tool, comprising: a tubular housing; a heat sink disposed adjacent to a heat generating device and configured to dissipate heat from the heat generating device; and a displacement mechanism configured to move the heat sink between a first position and a second position within the tubular housing, wherein, in the first position, a gap is formed between the heat sink and the tubular housing, and in the second position, the heat sink contacts the tubular housing. Such apparatus may further comprise: a chassis disposed within the tubular housing; and a biasing mechanism configured to bias the heat sink towards the chassis. Such apparatus may further comprise at least one bumper disposed on an end of the chassis. The displacement mechanism may comprise: a displacement member mounted to the heat sink; a spacer configured to engage the displacement member and move axially within the tubular housing; and an actuator assembly coupled to and configured to move the spacer. The spacer may comprise a rolling mechanism configured to engage the displacement member and move axially within the tubular housing. The displacement member may comprise a biasing member, such as a bow spring. The actuator assembly may comprise: a linear link coupled to and configured to move the spacer; and a screw coupled to and configured to move the linear link. The displacement mechanism may comprise a screw, wherein the heat sink is in a first position when the screw is in a first position, and wherein the heat sink is in a second position when the screw is in a second position. The apparatus may further comprise a thermally conductive material disposed on a surface of the heat sink proximate the tubular housing.

The present disclosure also introduces a method comprising: providing a tubular housing having an axis defined therethrough; disposing a heat generating device within the tubular housing; disposing a heat sink within the tubular housing, wherein the heat sink is disposed adjacent to the heat generating device and is configured to dissipate heat from the heat generating device; disposing a displacement mechanism within the tubular housing; and moving the heat sink from a first position to a second position within the tubular housing with the displacement mechanism; wherein, in the first position, a gap is formed between the heat sink and the tubular housing, and in the second position, the heat sink contacts the tubular housing. The method may further comprise disposing a chassis within the tubular housing, wherein the heat sink is mounted to the chassis. Moving the heat sink from the first position to the second position may comprise: providing a displacement member mounted to the heat sink; moving a rolling assembly configured to engage the displacement member within the tubular housing from a first position and a second position; and actuating an actuator assembly of the displacement mechanism coupled to the displacement member to move the rolling assembly. Moving the rolling assembly from the first position and the second position may comprise moving a linear link coupled to the rolling assembly from a first position to a second position. Actuating the actuator assembly may comprise: rotating a screw coupled to a linear link from a first position to a second position; and moving the linear link from the first position to the second position, thereby moving the heat sink to move from a first position and a second position.

The present disclosure also introduces an apparatus comprising: a heat generating device configured for use in a downhole tool; a heat sink disposed adjacent to the heat generating device and configured to move between a first position and a second position along an axis of a chassis of the downhole tool, wherein the heat sink is mounted to the chassis; and a rolling assembly configured to engage the displacement member and move along the axis; wherein in the first position, a gap is formed between the heat sink and a tubular housing of the downhole tool, and in the second position, the heat sink contacts the tubular housing. The apparatus may further comprise a bow spring mounted to the heat sink. The apparatus may further comprise: a linear link coupled to the rolling assembly and configured to move the rolling assembly; and a screw coupled to the linear link and configured to move the linear link. The chassis may be configured to be engaged within the tubular housing of the downhole tool. The apparatus may further comprise a thermally conductive material disposed on a surface of the heat sink The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus comprising:

a chassis positionable within a housing of a downhole tool;

a heat sink coupled to the chassis;

a displacement mechanism coupled to the heat sink and actuatable to move the heat sink, with respect to the chassis, between a first position and a second position such that in the first position the heat sink is radially retracted toward the chassis to form a gap between the heat sink and the housing and such that in the second position the heat sink is radially extended from the chassis to contact the housing; wherein the displacement mechanism comprises at least one displacement member coupled to a surface of the heat sink; and a spacer disposed between the at least one displacement member and the chassis and axially movable along the chassis to actuate the displacement member and move the heat sink between the first and second positions.

2. The apparatus of claim 1 wherein the heat sink is coupled to the chassis by a biasing mechanism configured to bias the heat sink toward the chassis such that the heat sink is in the first position.

3. The apparatus of claim 1 comprising at least one bumper coupled orthogonally to the chassis to position the chassis within the downhole tool.

4. The apparatus of claim 1 wherein the displacement mechanism comprises at least one curved member coupled to a first surface of the heat sink, wherein the first surface of the heat sink is disposed opposite from a second surface of the heat sink that contacts the housing in the second position.

5. The apparatus of claim 4 wherein the at least one curved member curves toward the chassis.

6. The apparatus of claim 1 wherein the spacer comprises a rolling mechanism configured to roll along a surface of the chassis and contact a middle portion of the at least one displacement member to move the heat sink to the second position.

7. The apparatus of claim 1 wherein the displacement member comprises a bow spring.

8. The apparatus of claim 1 wherein the displacement mechanism comprises:

a linear link coupled to the spacer; and a screw rotatably disposed within the linear link to move the linear link and the spacer axially along the chassis upon rotation of the screw.

9. A method comprising:

disposing a chassis of a heat dissipating apparatus within a housing of a downhole tool, wherein the heat dissipating apparatus comprises a heat sink coupled to the chassis; and actuating a displacement mechanism to move the heat sink, with respect to the chassis, from a first position, where the heat sink is radially retracted toward the chassis to form a gap between the heat sink and the housing, to a second position, where the heat sink is radially extended from the chassis to contact the housing.

10. The method of claim 9 wherein disposing a chassis comprises inserting the chassis to extend axially within the downhole tool.

11. The method of claim 9, wherein actuating a displacement mechanism comprises moving a spacer axially within the downhole tool between the chassis and the heat sink to contact a displacement member coupled to the heat sink.

12. The method of claim 11, wherein moving a spacer comprises turning a screw to move, axially along the chassis, a linear link coupled to the spacer.

13. The method of claim 9, wherein actuating a displacement mechanism comprises applying axial force to a rolling assembly disposed between the chassis and the heat sink to move the rolling assembly into contact with a curved portion of a displacement member coupled to the heat sink.

14. The method of claim 9, wherein actuating a displacement mechanism comprises applying axial force to a spacer that translates the axial force into a radial force applied to the heat sink.

15. An apparatus comprising:

a chassis disposed axially within a housing of a downhole tool;

a heat sink coupled to the chassis;

a heat generating device disposed within the downhole tool adjacent to the heat sink; and a displacement mechanism coupled to the heat sink and actuatable to move the heat sink, with respect to the chassis, between a first position and a second position such that in the first position the heat sink is radially extended from the chassis so that a first surface of the heat sink contacts the housing and in the second position the heat sink is radially retracted toward the chassis to form a gap between the first surface of the heat sink and the housing; wherein the displacement mechanism comprises a curved member coupled to a second surface of the heat sink opposite from the first surface, wherein the curved member curves outwardly from the second surface toward the chassis; and the displacement member further comprises a roller assembly disposed between the curved member and the chassis and configured to roll along a surface of the chassis.

16. The apparatus of claim 15 wherein the roller assembly is configured to roll along the curved member to force the heat sink away from the chassis.

17. The apparatus of claim 15 wherein the heat generating device contacts the second surface of the heat sink.

* * * * *